US009371745B2

(12) United States Patent
Takahashi et al.

(10) Patent No.: US 9,371,745 B2
(45) Date of Patent: Jun. 21, 2016

(54) VAPORIZATION METHOD AND VAPORIZATION APPARATUS USED FOR VAPORIZATION METHOD, AND VAPORIZATION SYSTEM PROVIDED WITH VAPORIZATION APPARATUS

(75) Inventors: Kazuo Takahashi, Kobe (JP); Norio Oiwa, Nagoya (JP)

(73) Assignees: Kobe Steel, Ltd., Hyogo (JP); CHUBU ELECTRIC POWER COMPANY, INCORPORATED, Aichi (JP)

( * ) Notice: Subject to any disclaimer, the term of this patent is extended or adjusted under 35 U.S.C. 154(b) by 359 days.

(21) Appl. No.: 13/702,297

(22) PCT Filed: May 27, 2011

(86) PCT No.: PCT/JP2011/002972

§ 371 (c)(1), (2), (4) Date: Dec. 5, 2012

(87) PCT Pub. No.: WO2011/155146

PCT Pub. Date: Dec. 15, 2011

(65) Prior Publication Data

US 2013/0081390 A1 Apr. 4, 2013

(30) Foreign Application Priority Data

Jun. 9, 2010 (JP) ..... 2010-131650

(51) Int. Cl.
*F02G 1/04* (2006.01)
*F01K 21/02* (2006.01)
(Continued)

(52) U.S. Cl.
CPC ..... *F01K 21/02* (2013.01); *F02G 1/055* (2013.01); *F28D 7/0058* (2013.01); *F28D 7/06* (2013.01);
(Continued)

(58) Field of Classification Search
CPC ..... F02G 1/04; F01K 17/02; F01K 15/00; F01B 29/10; B60L 1/02; F28F 7/00; F17C 9/02
USPC ..... 60/39.6, 520, 517; 165/60, 104.16
See application file for complete search history.

(56) References Cited

U.S. PATENT DOCUMENTS 4,300,625 A * 11/1981 Mikhailov ..... B01J 19/002 165/104.16
4,367,625 A * 1/1983 Vitale ..... F02G 1/0435 60/517
(Continued)

FOREIGN PATENT DOCUMENTS

JP 53-14258 A 2/1978
JP 53014258 A * 2/1978 ..... 60/517
(Continued)

OTHER PUBLICATIONS

English Translation of JP 03044065 A.*
(Continued)

*Primary Examiner* — Kenneth Bomberg
*Assistant Examiner* — Shafiq Mian
(74) *Attorney, Agent, or Firm* — Studebaker & Brackett PC

(57) ABSTRACT

A vaporization method includes a preparing step of preparing a vaporizing tube that covers at least a part of a heat exchange unit for cold energy of a Stirling engine and is capable of forming an ascending flow of the liquid flowing from a bottom to a top of the heat exchange unit for cold energy, and a vaporizing step of feeding the liquid in the vaporizing tube to thereby form the ascending flow and bringing the liquid into contact with the Stirling engine to vaporize the liquid. In the preparing step, a flowing direction of the ascending flow is adjusted to suppress occurrence of separated flows of the liquid and gas in the vaporizing tube. In the vaporizing step, the liquid is fed at a flow velocity at which a gas-liquid two-phase flow in which the liquid and the gas are mixed is formed in the vaporizing tube.

12 Claims, 6 Drawing Sheets

(51) Int. Cl.

| | |
|---|---|
| ***F02G 1/055*** | (2006.01) |
| ***F28F 13/00*** | (2006.01) |
| ***F28D 7/00*** | (2006.01) |
| ***F28D 7/06*** | (2006.01) |
| ***F28F 1/32*** | (2006.01) |
| *F28D 21/00* | (2006.01) |

(52) U.S. Cl.
CPC . *F28F 1/32* (2013.01); *F28F 13/00* (2013.01); *F02G 2256/00* (2013.01); *F28D 2021/0064* (2013.01)

(56) References Cited

U.S. PATENT DOCUMENTS

| | | | | |
|---|---|---|---|---|
| 4,367,791 | A | 1/1983 | Asami | |
| 4,462,212 | A * | 7/1984 | Knoos | F02G 1/0445 60/526 |
| 4,499,944 | A * | 2/1985 | Komakine | B01J 8/1836 122/4 D |
| 4,532,771 | A | 8/1985 | Momose et al. | |
| 5,341,769 | A | 8/1994 | Ueno et al. | |
| 5,394,700 | A * | 3/1995 | Steele | F02G 1/044 60/517 |
| 5,406,807 | A | 4/1995 | Ashiwake et al. | |
| 5,711,232 | A * | 1/1998 | Yamaguro | F02G 1/055 110/212 |
| 5,927,080 | A * | 7/1999 | Lee | F25B 9/14 60/520 |
| 6,089,028 | A * | 7/2000 | Bowen | F01K 25/10 62/50.2 |
| 6,513,326 | B1 * | 2/2003 | Maceda | F02G 1/043 60/517 |
| 6,715,313 | B1 * | 4/2004 | Takafu | F02G 1/00 60/517 |
| 8,640,454 | B1 * | 2/2014 | Nord | F02G 1/05 60/520 |
| 2005/0138926 | A1 * | 6/2005 | Richardson | F02G 1/047 60/520 |
| 2007/0193266 | A1 * | 8/2007 | McConaghy | F02G 1/0435 60/520 |
| 2007/0214804 | A1 * | 9/2007 | Hannan et al. | 62/50.2 |
| 2007/0214807 | A1 * | 9/2007 | Faka | 62/50.2 |
| 2008/0250795 | A1 * | 10/2008 | Katdare et al. | 62/50.2 |
| 2011/0041492 | A1 * | 2/2011 | Maguire | F02G 1/043 60/520 |

FOREIGN PATENT DOCUMENTS

| | | | | |
|---|---|---|---|---|
| JP | 3-044065 | A | 2/1991 | |
| JP | 03044065 | A * | 2/1991 | 60/517 |
| JP | 6-104357 | | 4/1994 | |
| JP | 11-022550 | A | 1/1999 | |
| JP | 2008-157144 | A | 7/2008 | |
| JP | 2008157144 | A * | 7/2008 | |
| JP | 2009-144538 | A | 7/2009 | |

OTHER PUBLICATIONS

English Translation of JP 53014258 A.*

Written Opinion of the International Searching Authority issued from the International Bureau in the corresponding International Application No. PCT/JP2011/002972, mailed Jan. 15, 2013, 6 pages.

International Search Report issued from the International Bureau in the corresponding International Application No. PCT/JP2011/002972, mailed Aug. 16, 2011, 2 pages.

Kikai Kogaku Binran Kiso Hen A6 Netsu Kogaku, The Japan Society of Mechanical Engineers, Dec. 25, 1985, p. A6-138, in Japanese, with 4 pages of its English translation.

The extended European search report issued by the European Patent Office on Nov. 30, 2015, which corresponds to European Patent Application No. 11792108.0-1606 and is related to U.S. Appl. No. 13/702,297.

* cited by examiner

VAPORIZATION METHOD AND VAPORIZATION APPARATUS USED FOR VAPORIZATION METHOD, AND VAPORIZATION SYSTEM PROVIDED WITH VAPORIZATION APPARATUS

TECHNICAL FIELD

The present invention relates to a vaporization method for vaporizing liquid while recovering power using a Stirling engine, a vaporization apparatus used for the vaporization method, and a vaporization system provided with the vaporization apparatus.

BACKGROUND ART

A Stirling engine has been known in the past. The Stirling engine includes a heat exchange unit for hot energy and a heat exchange unit for cold energy. Hot energy is supplied to the heat exchange unit for hot energy and cold energy is supplied to the heat exchange for cold energy, whereby the Stirling engine obtains power.

A technology is known for vaporizing liquid while recovering power by adopting cold energy (latent heat) of the liquid as the cold energy supplied to the Stirling engine of this type (e.g., Patent Document 1). In other words, the Stirling engine according to Patent Document 1 vaporizes liquid (LNG: liquefied natural gas) while recovering power by applying the heat of vaporization to the liquid.

Specifically, a Stirling engine 102 of Patent Document 1 includes, as shown in FIG. 7, a cooler 104 provided on the outer side of a head (a heat exchange unit for cold energy) of a displacer cylinder 106 of the Stirling engine 102. The cooler 104 cools the head of the displacer cylinder 106 with the latent heat of the LNG supplied to the inside of the cooler 104. As a result of the cooling, the LNG from which the latent heat is transferred (to which the heat of vaporization is applied) vaporizes.

However, in the Stirling engine 102 of Patent Document 1, complicated processing is necessary in order to obtain target gas from the liquid (LNG) at high efficiency. Specifically, the Stirling engine 102 of Patent Document 1 is configured to immerse the head of the Displacer cylinder 106 in the liquid stored in the cooler 104 in order to bring the liquid into contact with the displacer cylinder 106. Therefore, gas already vaporized and gas not vaporized yet are separated. In order to obtain target gas at high efficiency in a state in which the liquid and the gas are separated in this way, as shown in FIG. 7, it is necessary to separately collect the gas and the liquid from the cooler 104, keep a state in which the gas is heated and vaporized by a heater 105*a* and vaporize the liquid with a vaporizer 105*b*, and mix the gas from the heater 105*a* and the vaporizer 105*b* with a mixer 115.

Therefore, in order to obtain target gas at high efficiency using the Stirling engine 102 of Patent Document 1, there is a problem in that a process and equipment therefor are complicated.

Patent Document 1: Japanese Patent Application Laid-Open No. H11-22550

SUMMARY OF THE INVENTION

An object of the present invention is to provide a vaporization method that can obtain target gas at high efficiency using a Stirling engine without requiring a complicated process and complicated equipment, a vaporization apparatus used for the vaporization method, and a vaporization system provided with the vaporization apparatus.

According to an aspect of the present invention, there is provided a method of vaporizing liquid using a Stirling engine including a heat exchange unit for cold energy, the method including: a preparing step of preparing a conduit that covers at least a part of the heat exchange unit for cold energy of the Stirling engine and is capable of forming an ascending flow of the liquid flowing from a bottom to a top of the heat exchange unit for cold energy; and a vaporizing step of feeding the liquid in the conduit to thereby form the ascending flow and bringing the liquid into contact with the Stirling engine to vaporize the liquid. In the preparing step, a flowing direction of the ascending flow is adjusted to be an angle set in advance for suppressing occurrence of separated flows of the liquid and gas in the conduit. In the vaporizing step, the liquid is fed at a flow velocity at which a gas-liquid two-phase flow in which the liquid and the gas are mixed is formed in the conduit.

BEST MODE FOR CARRYING OUT THE INVENTION

A preferred embodiment of the present invention is explained below with reference to the drawings.

Figure 1:
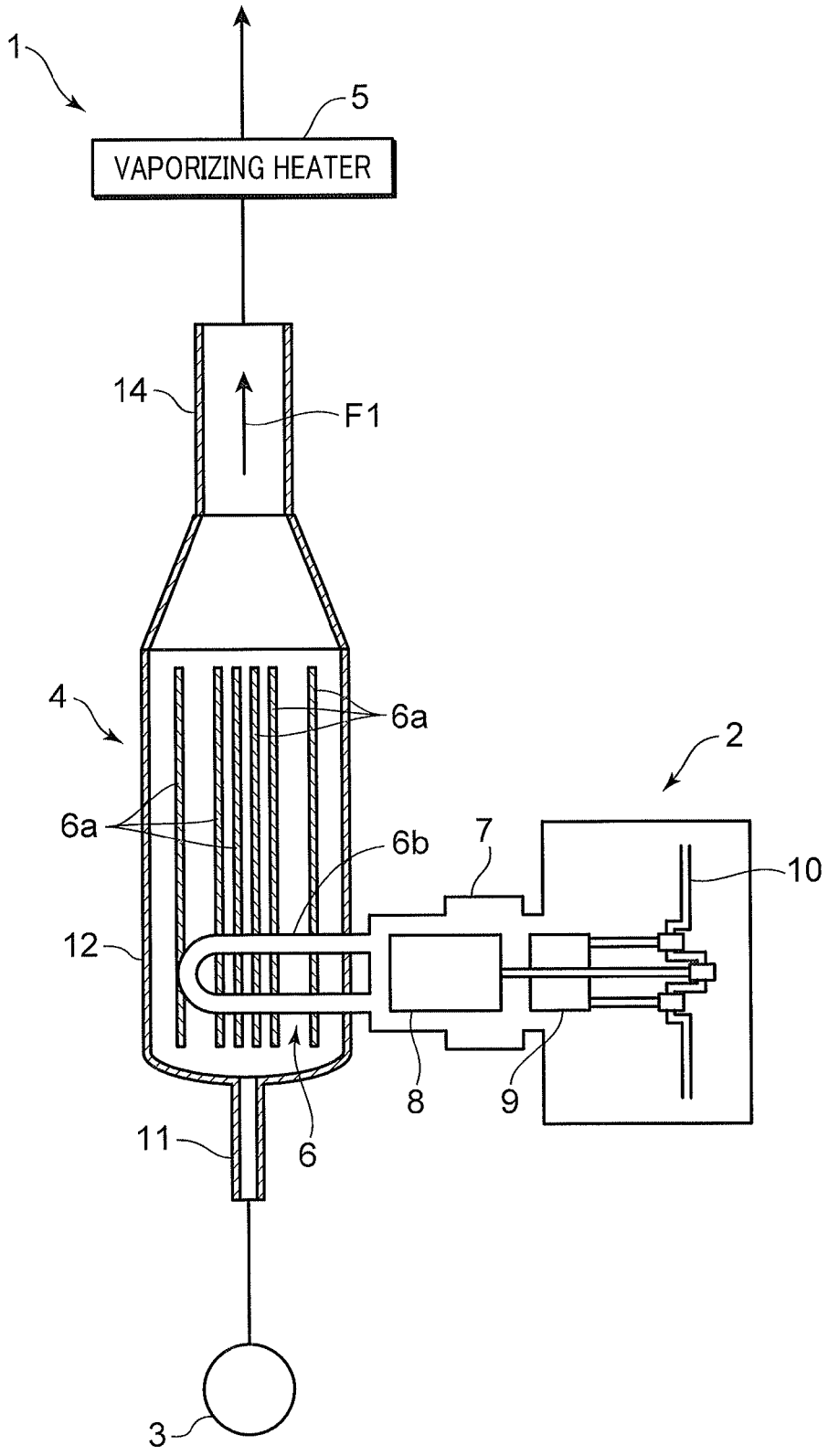
FIG. 1 is a schematic diagram showing an overall configuration of a vaporization system according to an embodiment of the present invention.
Figure 2:
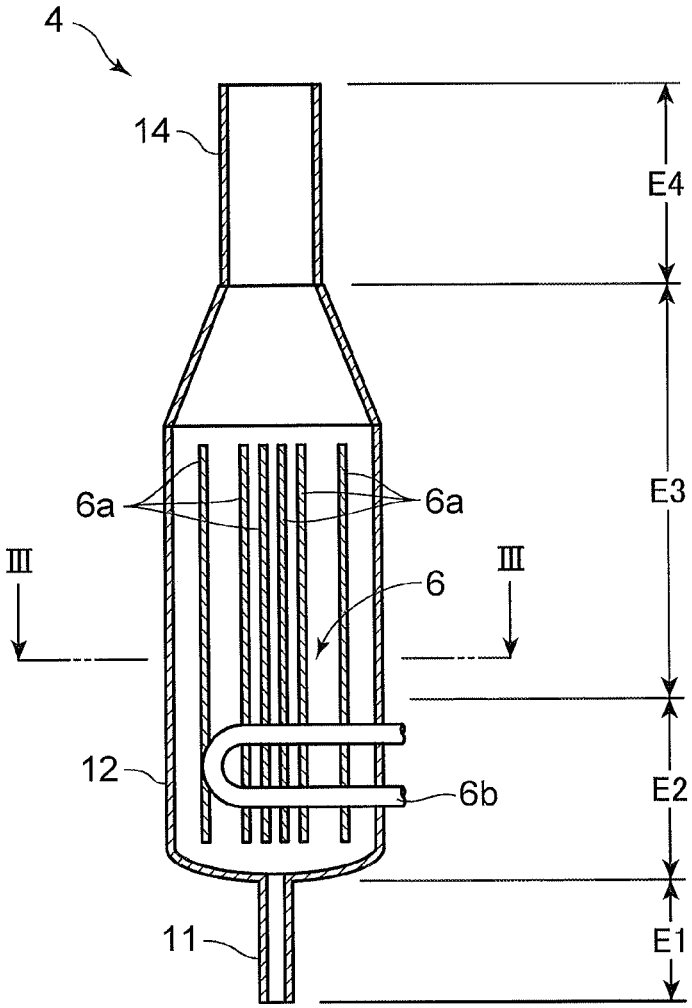
FIG. 2 is a sectional view showing in enlargement a vaporizing tube shown in FIG. 1.
Figure 3:
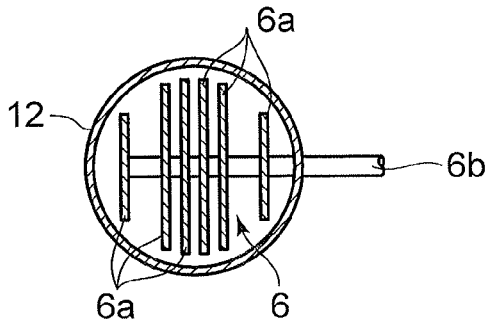
FIG. 3 is a line sectional view of FIG. 2.

FIG. 1 is a schematic diagram showing an overall configuration of a vaporization system according to an embodiment of the present invention. FIG. 2 is a sectional view showing in enlargement a vaporizing tube shown in FIG. 1. FIG. 3 is a III-III line sectional view of FIG. 2.

Referring to FIGS. 1 to 3, a vaporization system 1 includes a Stirling engine 2, a vaporizing tube 4 attached to the Stirling engine 2, a pump 3 that supplies LNG (liquefied natural gas) to the vaporizing tube 4, and a vaporizing heater 5 that vaporizes or heats fluid led out from the vaporizing tube 4. The Stirling engine 2 and the vaporizing tube 4 configure a vaporization apparatus in this embodiment.

The Stirling engine 2 includes a heat exchange unit for cold energy 6 for cooling working gas (e.g., hydrogen gas or nitrogen gas) in a not-shown displacer cylinder and a heat exchange unit for hot energy 7 for heating the gas in the displacer cylinder, a displacer piston 8 movable in the displacer cylinder, a power piston 9 movable according to compression or expansion of the gas in the displacer cylinder, and a crankshaft 10 to which the displacer piston 8 and the power piston 9 are coupled. In the Stirling engine 2, when the gas in the displacer cylinder is cooled in the heat exchange unit for cold energy 6, the power piston 9 moves in a direction for reducing the volume of the displacer cylinder. According to the movement of the power piston 9, the displacer piston 8 moves in a direction for increasing the volume on the heat exchange unit for hot energy 7. Then, according to the increase in the gas heated by the heat exchange unit for hot energy 7, the power piston 9 moves in a direction for increasing the volume of the displacer cylinder. According to the movement, the displacer piston 8 moves in a direction for increasing the volume of the heat exchange unit for cold energy 6. This action is repeatedly performed, whereby power used for a rotating action of the crankshaft 10 can be recovered.

The heat exchange unit for cold energy 6 includes a U-shaped metal tube (an encapsulating section) 6*b* in which the working gas circulates and six metal plates (extending sections) 6*a* heat-conductibly coupled to the metal tube 6*b*. Each of the metal plates 6*a* is arranged in a standing posture. The metal plates 6*a* are arranged substantially in parallel to one another in a state in which the metal plates 6*a* are pierced through by the metal tube 6*b*. The metal plates 6*a* are arranged such that regions on one side (the upper side in FIGS. 1 and 2) are long compared with regions on the other side (the lower side in FIGS. 1 and 2) with respect to the metal tube 6*b*.

The vaporizing tube 4 is a conduit for vaporizing the LNG. When the LNG circulates inside the vaporizing tube 4 in a state in which the vaporizing tube 4 is attached to the Stirling engine 2, the LNG in the vaporizing tube 4 vaporizes with the heat of vaporization received from the heat exchange unit for cold energy 6. Specifically, the vaporizing tube 4 includes a lead-in section 11 for leading in the LNG from the pump 3, a vaporizing section (a heat exchange section or an auxiliary heat exchange section) 12 that cools the heat exchange unit for cold energy 6 of the Stirling engine 2 with the LNG from the lead-in section 11, and a lead-out section 14 for leading out the LNG from the vaporizing section 12. The lead-in section 11, the vaporizing section 12, and the lead-out section 14 are coaxially arranged along an axis in the up-down direction. Consequently, a channel in the vaporizing tube 4 has a shape for circulating liquid in a direction having an upward component in the entire range from the lead-in section 11 to the lead-out section 14. 'The shape for circulating liquid in a direction having an upward component in the entire range from the lead-in section 11 to the lead-out section 14' means the shape of the channel that can be arranged in a state not including a section where a position on an upstream side is higher than a position on a downstream side. This means that the shape is not limited to a linear shape and includes a curved shape.

The vaporizing section 12 houses the distal end of the metal tube 6*b* and the metal plates 6*a*. Specifically, in the vaporizing section 12, the metal plates 6*a* are arranged to extend along the axis of the vaporizing tube 4 in a state in which the sidewalls of the metal plates 6*a* are pierced through by the metal tube 6*b*. The vaporizing section 12 houses the metal plates 6*a* in a posture in which portions on one side (the upper side in FIGS. 1 and 2) of the metal plates 6*a* extending longer than the other side (the lower side of FIGS. 1 and 2) with respect to the metal tube 6*b* face the lead-in section 14. In other words, the metal plates 6*a* have a shape extending long toward the downstream side in a flowing direction of the LNG from the metal tube 6*b*.

Figure 4:
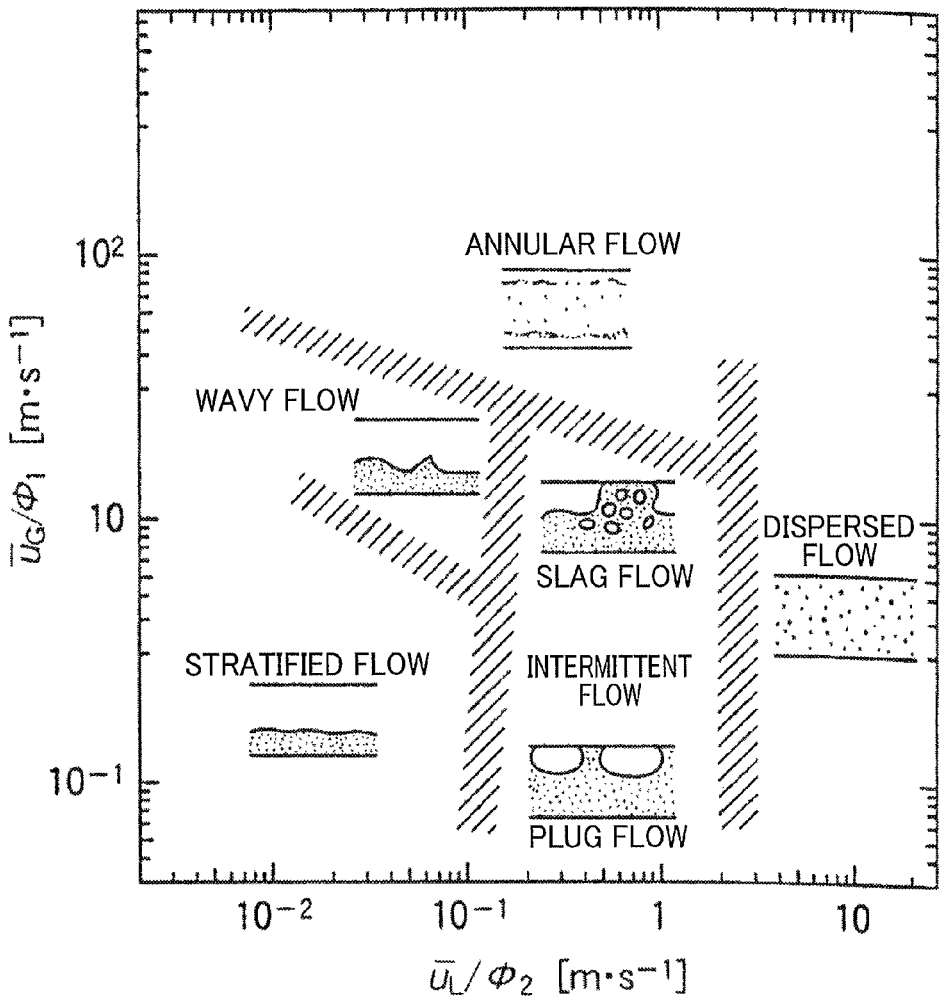
FIG. 4 is a diagram showing a fluidized state of the gas-liquid two-phase flow in the horizontal direction.
Figure 5:
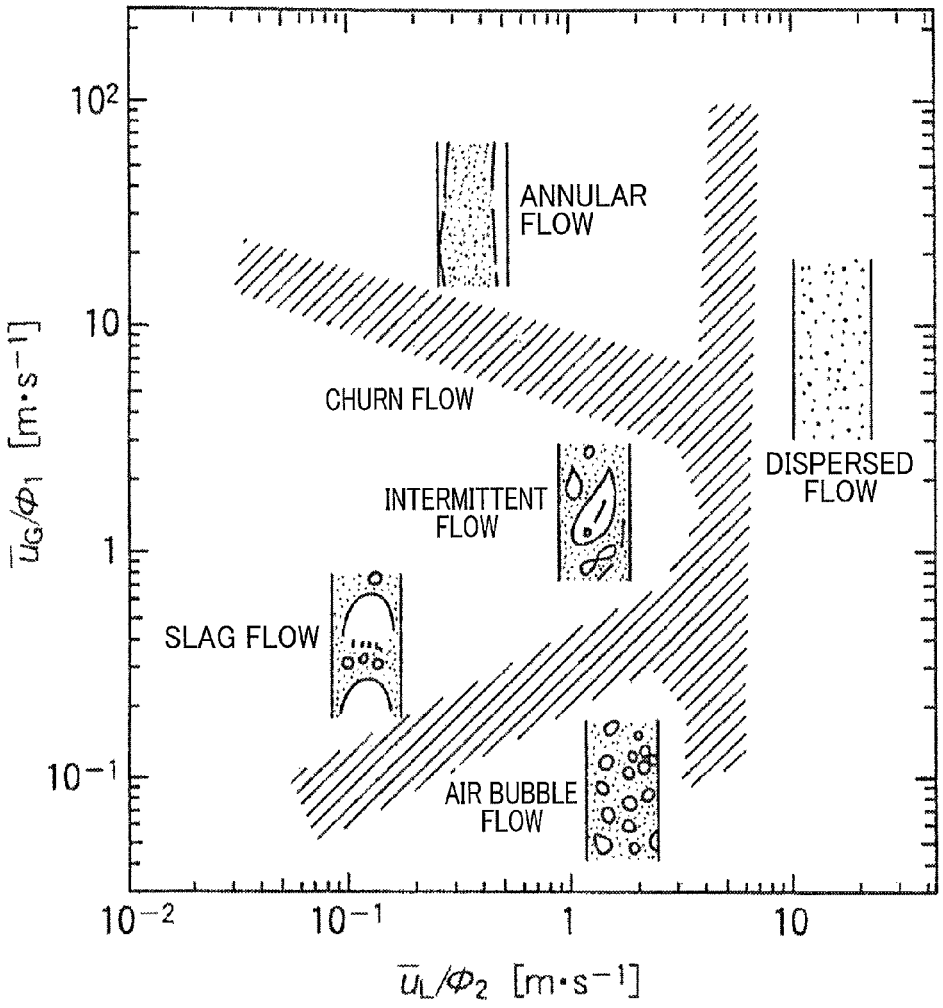
FIG. 5 is a diagram showing a fluidized state of the gas-liquid two-phase flow in the vertical direction.

The vaporizing tube 4 according to this embodiment is attached to the Stirling engine 2 to form a vertical ascending flow F1 (see FIG. 1). Specifically, the vaporizing tube 4 is attached to the Stirling engine 2 to have a posture in which the lead-in section 11 is on the lower side and the lead-out section 14 is on the upper side and axes thereof extend along the vertical direction in the vaporizing section 12. When the vertical ascending flow F1 of the fluid flowing upward is formed in the vaporizing tube 4, unlike the formation of the gas-liquid two-phase flow in the horizontal direction, separated flows (a wavy flow and a stratified flow: see FIG. 4) are not generated. As shown in FIG. 5, a gas-liquid two-phase flow in which the liquid and the gas are mixed is formed.

Specifically, the vaporizing tube 4 has an inner diameter dimension set to generate an air bubble flow concerning a range E1 (see FIG. 2) of the lead-in section 11 and a range E2 (see FIG. 2: the heat exchange section) in which the metal tube 6*b* and the liquid from the pump 3 come into contact with each other, generate an air bubble flow, a slag flow, or an intermittent flow concerning a range E3 (see FIG. 2: the auxiliary heat exchange section) further on the downstream side than the metal tube 6*b* in the vaporizing section 12, and generate an intermittent flow or an annular flow concerning a range E4 of the lead-out section 14 in a fluidized state of the gas-liquid two-phase flow in the vertical ascending flow F1 shown in FIG. 5. The air bubble flow means a flow of air bubbles dispersing in the liquid when the flow velocity of the gas is small. The intermittent flow means a flow including a slag flow in which liquid slag containing small air bubbles and gas slag alternately flow and a churn flow in which the flow velocity of the liquid increases and a large number of large and small air bubbles are present in the liquid. The annular flow means that the liquid flows along a tube wall and the gas continuously flows in a tube center. A method of setting the inner diameter dimension of the vaporizing tube 4 for forming the fluidized state is explained below.

(1) Concerning the Range E1 and the Range E2

Concerning the range E1 and the range E2, an inner diameter dimension d serving as a flow velocity parameter $U_L/\phi 2$ of a liquid phase is calculated on the basis of Formula 1 below such that the fluidized state of the gas-liquid two-phase flow shown in FIG. 5 is the air bubble flow. $U_L$ is a flow velocity in the liquid phase, $\phi 2$ is a correction coefficient set to have a value of 1 when the inner diameter of the conduit is 2.54 cm, and $d^0$ is a reference inner diameter dimension (2.54 cm).

$$\phi 2 = d/d^{\circ} \qquad \text{Formula 1}$$

In this embodiment, the inner diameter dimension of the range E1 is set smaller than the inner diameter dimension of the range E2. As a result, the flow velocity in the range E1 increases. Consequently, the density of the liquid in the gas-liquid two-phase flow in the range E1 is equal to or higher than the density of the liquid in the gas-liquid two-phase flow in the range E2. Therefore, it is possible to keep large cold energy of the gas-fluid two-phase flow in the range E1, which is a pre-stage of the range E2, i.e., the heat exchange section. As a result, it is possible to further improve the efficiency of heat exchange.

(2) Concerning the Range E3

Concerning the range E3, the flow velocity parameter $U_L/\phi 2$ of the liquid phase is calculated on the basis of Formula 1 above and a flow velocity parameter $U_G/\phi 1$ of the gas phase is calculated on the basis of Formula 2 below such that the fluidized state of the gas-liquid two-phase flow generated in the range E2 is the air bubble flow, the slag flow, or the intermittent flow. The inner diameter dimension d of the range E3 is set to satisfy these conditions. The flow velocity parameter $U_L/\phi 2$ of the liquid phase concerning the air bubble flow, the slag flow, or the intermittent flow is the same as Formula 1 above. $U_G$ is the flow velocity of the gas phase, $\phi 1$ is a correction coefficient set to have a value of 1 when the inner diameter of the conduit is 2.54 cm, and $\theta$ is an angle (in this embodiment, 90°) formed by the flowing direction of the LNG and the horizontal direction.

$$\phi 1 = (d/d^{\circ})^{0.8}(1-0.65\cos\theta) \qquad \text{Formula 2}$$

(3) Concerning the Range E4

Concerning the range E4, the inner diameter dimension d is set such that the fluidized state of the gas-liquid two-phase flow generated in the range E3 is the intermittent flow or the annular flow. Specifically, when the intermittent flow is formed, the flow velocity parameter $U_L/\phi 2$ of the liquid phase is calculated on the basis of Formula 1 above, the flow velocity parameter $U_G/\phi 1$ of the gas phase is calculated on the basis of Formula 2 above, and the inner dimension parameter d of the range E4 is set to satisfy these conditions.

On the other hand, when the annular flow is formed, the flow velocity parameter $U_L/\phi 2$ of the liquid phase is calculated, the flow velocity parameter $U_G/\phi 1$ of the gas phase is calculated on the basis of Formula 3 below, and the inner dimension parameter d of the range E4 is set to satisfy these conditions. $\phi 2$ in the formation of the annular flow is 1. Therefore, a flow velocity parameter of the liquid phase depends on the flow velocity $U_L$. $\rho_G$ is the density of the gas, $\rho_G^0$ is 1.3 kg×m$^{-3}$, $\Delta\rho^0$ is $(\rho_L^0-\rho_G^0)$, $\Delta\rho$ is $(\rho_L-\rho_G)$, $\sigma^0$ is 0.07 N×m$^{-1}$, and $\sigma$ is surface tension.

$$\phi 1 = \left(\frac{\rho_G^\circ}{\rho_G}\right)^{0.23}\left(\frac{\Delta\rho}{\Delta\rho^\circ}\right)^{0.11}\left(\frac{\sigma}{\sigma^\circ}\right)^{0.11}\left(\frac{d}{d^\circ}\right)^{0.415} \quad \text{Formula 3}$$

The operation of the vaporization system 1 is explained below.

First, as explained above, the vaporizing tube 4 that covers the heat exchange unit for cold energy 6 of the Stirling engine 2 and is capable of forming a vertical ascending flow of the liquid flowing from the bottom to the top of the heat exchange unit for cold energy 6 is prepared (a preparing step).

Subsequently, the pump 3 is provided below the vaporizing tube 4 and the vaporizing heater 5 is provided above the vaporizing tube 4. The LNG is ejected from the pump 3, whereby the vertical ascending flow F1 of the LNG led in from below (the lead-in section 11) the vaporizing tube 4 and led out from above (the lead-out section 14) the vaporizing tube 4 is formed.

Specifically, the LNG changes to an air bubble flow in the lead-in section 11 (the range E1) to be led into the vaporizing section 12. The liquid not vaporized yet in the LNG led into the vaporizing section 12 in the state of the air bubble flow comes into contact with the metal tube 6*b* in the range E2 and receives the heat of vaporization from the metal tube 6*b* to thereby vaporize (a vaporizing step). Consequently, in the range E3 located further on the downstream side than the range E2, as an air bubble flow same as that in the range E2 or a slag flow or an intermittent flow having a less liquid phase compared with the range E2 is formed. In the range E3, the liquid not vaporized yet in the gas-liquid two-phase flow led in from the range E2 comes into contact with the metal plates 6*a* and receives the heat of vaporization from the metal plates 6*a* to thereby vaporize. The gas-liquid two-phase flow from the range E3 is led out from the lead-out section 14 in a state in which the gas-liquid two-phase flow is changed to an intermittent flow or an annular flow in the range E4.

Further, in this embodiment, the vaporizing heater 5 is provided on the lead-out section 14 and the gas-liquid two-phase flow led out from the lead-out section 14 is guided to the vaporizing heater 5 in the form of the ascending flow F1 (a guiding step). Therefore, the liquid not vaporized by the heat exchange unit for cold energy 6 of the Stirling engine 2 is guided to the vaporizing heater 5 together with the liquid already vaporized and is vaporized in the vaporizing heater 5. On the other hand, the gas is heated in the vaporizing heater 5.

As explained above, according to the embodiment, since the vertical ascending flow F1 is formed, it is possible to suppress occurrence of separated flows of the liquid and the gas in the vaporizing tube 4. Therefore, even when the flow velocity of the liquid is low, it is possible to maintain the gas-liquid two-phase flow in which the gas and the liquid are mixed without a gas-liquid interface being separated. A reason for the above is explained with reference to FIGS. 4 and 5. In FIGS. 4 and 5, the abscissa indicates a parameter concerning the velocity of the liquid and the ordinate indicates a parameter concerning the velocity of the gas. As indicated by FIG. 4 showing the fluidized state of the gas-liquid two-phase flow in the horizontal direction, in the gas-liquid two-phase flow in the horizontal direction, a state in which the gas-liquid interface is separated (a wavy flow and a stratified flow) occurs according to a decrease in the flow velocity of the fluid. On the other hand, as in the embodiment, in the gas-liquid two-phase flow in the vertical direction (an ascending flow), the gas-liquid interface is not separated even if the flow velocity of the liquid decrease as shown in FIG. 5. It is possible to maintain the state of the slag flow or the air bubble flow. Therefore, in the gas-liquid two-phase flow in the vertical direction, it is possible to efficiently circulate the liquid and the gas already vaporized.

In the embodiment, 'an angle set in advance for suppressing occurrence of separated flows of the liquid and gas in the conduit' means an angle $\theta$ that satisfies the condition of Formula 4 below. $\theta$ is an angle formed by the flowing direction of the ascending flow and the horizontal direction, d is the inner diameter (the diameter) of the conduit, and 1 is a channel length of the gas-liquid two-phase flow in the conduit.

In the embodiment, the ascending flow is formed vertically. However, the ascending flow is not limited to be vertically formed. It is possible to suppress the occurrence of the separated flows if the flowing direction of the ascending flow is adjusted to be fit within a range of the angle $\theta$ of Formula 4 below.

$$\sin\theta > \frac{d}{1} \quad \text{Formula 4}$$

In the embodiment, after the occurrence of the separated flows is suppressed as explained above, the liquid is supplied from the pump 3 at a flow velocity at which the gas-liquid two-phase flow is formed in the vaporizing tube 4. Therefore, it is possible to effectively vaporize the liquid contained in the gas-liquid two-phase flow with the heat of vaporization received from the heat exchange unit for cold energy 6 of the Stirling engine 2 while effectively circulating the gas-liquid two-phase flow in the state in which the gas and the liquid are mixed.

Therefore, according to the embodiment, it is possible to perform vaporization of the remaining liquid while collecting the target gas by circulating the liquid and the gas as the gas-liquid two-phase flow of the vertical ascending flow F1. Therefore, it is possible to obtain the target gas at high efficiency without requiring a complicated process and complicated equipment. In particular, when liquid in which a plurality of components having different boiling points are mixed such as the LNG is supplied to the vaporizing tube 4, low-boiling point components can be easily vaporized by the heat of vaporization from the Stirling engine 2. On the other hand, high-boiling point components may be unable to be sufficiently vaporized by the heat of vaporization from the Stirling engine 2. However, by adopting the vaporization system according to the embodiment, it is possible to effectively guide low-boiling point components (gas) already vaporized and high-boiling point components (liquid) not vaporized yet to the vaporizing heater 5. Therefore, it is possible to vaporize the high-boiling components with the vaporizing heater 5. Consequently, it is possible to obtain target natural gas at high efficiency.

The embodiment is a configuration for forming the air bubble flow in the range E2 (the heat exchange section) and forming the air bubble flow, the slag flow, or the intermittent flow in the range E3 (the auxiliary heat exchange section). With this configuration, it is possible to circulate the liquid at a relatively low velocity and uniformly. Therefore, it is possible to surely bring the liquid and the heat exchange unit for cold energy 6 into contact with each other. Consequently, it is possible to realize efficiency of vaporization.

The embodiment is a configuration in which the inner diameter dimension of the lead-in section 11 is set smaller than the inner diameter dimension of the vaporizing section 12. With this configuration, it is possible to set the density of the liquid in the lead-in section 11 larger than the density of the liquid in the vaporizing section 12. Therefore, it is possible to maintain a state in which a lot of cold energy is retained at a stage before the liquid is guided to the vaporizing section 12. As a result, it is possible to more effectively perform vaporization in the vaporizing section 12.

In the embodiment, the heat exchange unit for cold energy 6 includes the metal tube (the encapsulating section) 6*b* and the plurality of metal plates (the extending sections) 6*a*. The gas-liquid two-phase flow is formed in the range E2 (the heat exchanging section) and the range E3 (the auxiliary heat exchanging section). With this form, it is possible to effectively vaporize the liquid in the range E3 in addition to the range E2.

If the liquid and the gas are led from the lead-out section 14 to the vaporizing heater 5 while being kept in the state of the ascending flow F1 as in the embodiment, it is possible to suppress the occurrence of the separate flows between the lead-out section 14 and the vaporizing heater 5 as well. Therefore, it is possible to vaporize the liquid, which is not vaporized by the Stirling engine 2, with the vaporizing heater 5 and obtain the target gas at high efficiency.

In the embodiment, the vaporizing tube 4 including the linear channel in which the lead-in section 11, the vaporizing section 12, and the lead-out section 14 are coaxially arranged is explained. However, the channel in the vaporizing tube 4 is not limited to the linear shape and may be, for example, a curved shape as long as the shape is the shape of the channel that can be arranged in a state in which the channel does not have a section where the position on the upstream side of the channel is higher than the position on the downstream side.

Figure 6:
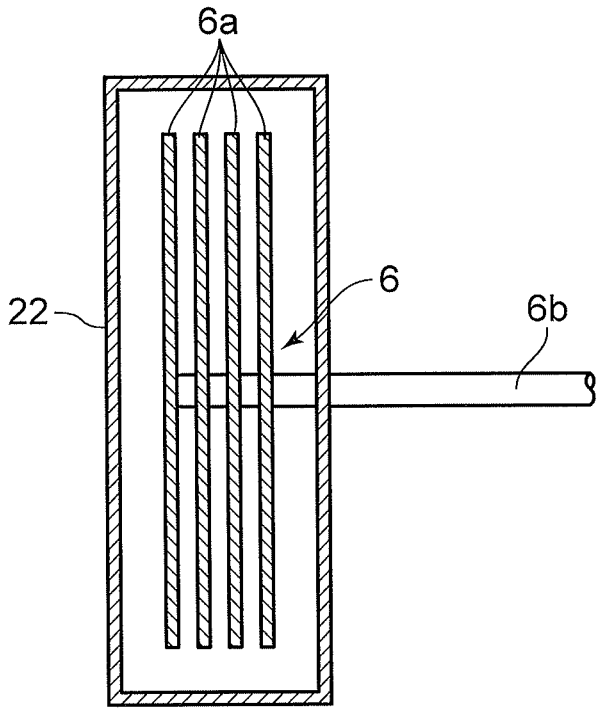
FIG. 6 is a sectional view showing a modification of the embodiment shown in FIG. 1.
Figure 7:
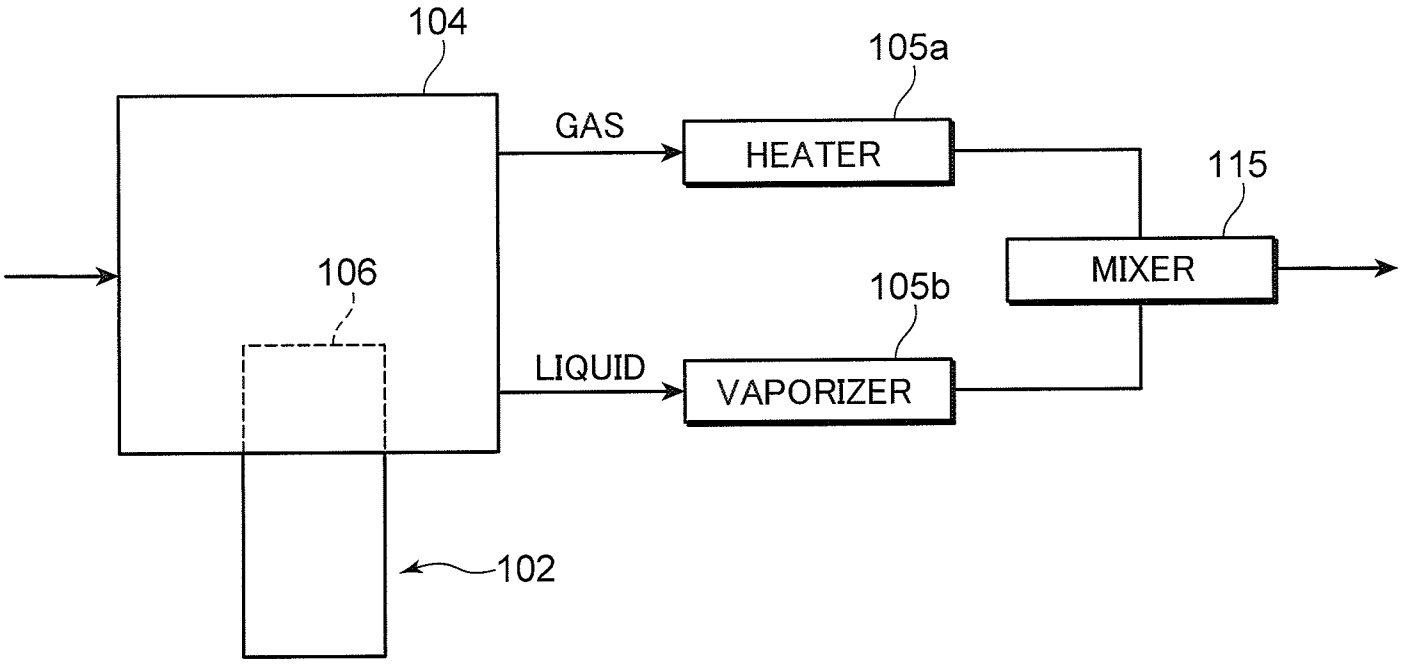
FIG. 7 is a schematic diagram showing the configuration of a vaporization system in the past.

In the embodiment, the cylindrical vaporizing tube 4 is explained. However, the sectional shape of the vaporizing tube is not limited to a circle and may be, for example, a rectangle as shown in FIG. 6. In the vaporizing tube 22, a representative diameter in the case in which a cylindrical container having a sectional area equal to the sectional area of the vaporizing tube 22 is assumed can be adopted as the inner diameter dimension d. This is because, since the sectional area is equal irrespective of the shape of the sectional area, a state of the gas-liquid two-phase flow is approximated.

EXAMPLE

The diameter dimension of the vaporizing tube 4 in the case in which LNG having 0.3 MPaG and −160° C. is supplied at a flow rate of 1 t/h is explained below. It is assumed that the LNG supplied to the vaporizing tube 4 is heated to −133° C. by heat exchange with the heat exchange unit for cold energy 6 of the Stirling engine 2.

(1) Concerning the Range E1 (see FIG. 2)

In this example, an air bubble flow is generated concerning the range E1. Therefore, a value of the flow velocity parameter $U_L/\phi 2$ is required to be smaller than 3 (see FIG. 5). If the diameter dimension d in the range E1 is set to 40 mm, $\phi 2$ ($=d/d^0$) is 1.575. Therefore, the flow velocity $U_L$ is required to be smaller than 4.724 m/sec.

It is examined whether the condition is satisfied. The density of the LNG at 0.3 MPaG and −160° C. is 460 kg/m$^3$. Therefore, the flow rate of the LNG in the range E1 is $0.604\times 10^{-3}$ m$^3$/sec. Since the diameter dimension d of the range E1 is 40 mm, the flow velocity $U_L$ is about 0.5 m/sec. Therefore, when the diameter dimension of the range E1 is set to 40 mm, the condition (the flow velocity $U_L<4.724$ m/sec) is satisfied.

(2) Concerning the Range E2 (see FIG. 2)

In this example, an air bubble flow is generated concerning the range E2. Therefore, a value of the flow velocity parameter $U_L/\phi 2$ is required to be smaller than 3 (see FIG. 5). If the diameter dimension d in the range E2 is set to 500 mm, $\phi 2$ (see Formula 1) is 19.69. Therefore, the flow velocity $U_L$ is required to be smaller than 59.06 m/sec.

It is examined whether the condition is satisfied. The density of the LNG at 0.3 MPaG and −160° C. is 460 kg/m$^3$. Therefore, the flow rate of the LNG in the range E2 is $0.604\times 10^{-3}$ m$^3$/sec. Since the diameter dimension d of the range E2 is 500 mm, the flow velocity $U_L$ is about $3.1\times 10^{-3}$ m/sec. Therefore, when the diameter dimension of the range E2 is set to 500 mm, the condition (the flow velocity $U_L<59.06$ m/sec) is satisfied.

(3) Concerning the Range E3 (see FIG. 2)

In this example, an air bubble flow, a slag flow, or an intermittent flow is generated concerning the range E3. Therefore, a value of the flow velocity parameter $U_G/\phi 1$ is required to be smaller than 1.0 (see FIG. 5). If the diameter dimension d in the range E3 is set to 500 mm, $\phi 1$ (see Formula 2: $\theta=90°$) is 10.85. Therefore, the flow velocity $U_G$ is required to be smaller than 10.85 m/sec.

It is examined whether the condition is satisfied. From a relation with the density of the LNG at 0.3 MPaG and −133° C., the flow rate of the LNG in the range E3 is 0.058 m$^3$/sec. Since the diameter dimension d of the range E3 is 500 mm, the flow velocity $U_G$ is about 0.3 m/sec.

(4) Concerning the Range E4 (see FIG. 2)

In this example, a slag flow, an intermittent flow, or an annular flow is generated concerning the range E4. Therefore, a value of the flow velocity parameter $U_G/\phi 1$ is required to be larger than 0.1 (FIG. 5). If the diameter dimension d in the range E4 is set to 120 mm, $\phi 1$ (see Formula 4: $\theta=90°$) is 3.46. Therefore, the flow velocity $U_G$ is required to be larger than 0.346 m/sec.

It is examined whether the condition is satisfied. From a relation with the density of the LNG at 0.3 MPaG and −133° C., the flow rate of the LNG in the range E4 is 0.058 m$^3$/sec. Since the diameter dimension d of the range E4 is 120 mm, the flow velocity $U_G$ is about 5 m$^3$/sec. Therefore, when the diameter dimension of the range E4 is set to 120 mm, the condition (the flow velocity $U_G>0.346$ m/sec) is satisfied.

Summary of the Embodiment

The embodiment explained above is summarized as explained below.

A vaporization method according to the embodiment is a method of vaporizing liquid using a Stirling engine including a heat exchange unit for cold energy, the method including: a preparing step of preparing a conduit that covers at least a part of the heat exchange unit for cold energy of the Stirling engine and is capable of forming an ascending flow of the liquid flowing from a bottom to a top of the heat exchange unit for cold energy; and a vaporizing step of feeding the liquid in the conduit to thereby form the ascending flow and bringing the liquid into contact with the Stirling engine to vaporize the liquid. In the preparing step, a flowing direction of the ascending flow is adjusted to be an angle set in advance for suppressing occurrence of separated flows of the liquid and gas in the conduit. In the vaporizing step, the liquid is fed at a flow velocity at which a gas-liquid two-phase flow in which the liquid and the gas are mixed is formed in the conduit.

With this configuration, since the flowing direction of the ascending flow is adjusted to the predetermined angle, it is possible to suppress the occurrence of the separated flows of the liquid and the gas in the conduit. Therefore, even when the flow velocity of the liquid is low, it is possible to maintain the gas-liquid two-phase flow in which the gas and the liquid are mixed without a gas-liquid interface being separated.

In the vaporizing step, the liquid is fed at a flow velocity at which an intermittent flow or an air bubble flow is formed in a heat exchange section of the conduit in which the heat exchange unit for cold energy and the liquid come into contact with each other.

With this configuration, it is possible to more effectively bring the liquid and the heat exchange unit for cold energy into contact with each other.

In the preparing step, the conduit is prepared including a heat exchange section in which the heat exchange unit for cold energy and the liquid come into contact with each other, and a lead-in section that has a sectional area smaller than a sectional area of a channel of the heat exchange section and that leads the liquid into the heat exchange section.

With this configuration, since the sectional area of the channel in the lead-in section is set smaller than the sectional area of the channel in the heat exchange section, it is possible to set the density of the liquid in the lead-in section larger than the density of the liquid in the heat exchange section. Therefore, it is possible to maintain a state in which a lot of cold energy is retained at a stage before the liquid is guided to the heat exchange section. As a result, it is possible to more effectively perform vaporization in the heat exchange section.

The heat exchange unit for cold energy includes an encapsulating section in which working gas of the Stirling engine is encapsulated, and a plurality of extending sections heat-conductibly coupled to the encapsulating section and extending in a flowing direction of the liquid from the encapsulating section. In the preparing step, the conduit is prepared including a heat exchange section which covers at least a part of the encapsulating section and in which the encapsulating section and the liquid come into contact with each other, and an auxiliary heat exchange section which covers the extending sections and in which the extending sections and the liquid come into contact with each other. In the vaporizing step, the liquid is fed at a flow velocity at which the gas-liquid two-phase flow is formed in the heat exchange section and the auxiliary heat exchange section.

With this configuration, it is possible to prepare the conduit including not only the heat exchange section but also the auxiliary heat exchange section as an area for vaporizing the liquid. Therefore, it is possible to more effectively perform vaporization by vaporizing the liquid in a large area.

The vaporization method according to the embodiment further includes a guiding step of guiding the liquid led out in the form of the ascending flow from the conduit to a vaporizing heater for vaporizing the liquid and heating the gas.

With this configuration, since the liquid and the gas led out from the conduit is guided while being kept in the state of the ascending flow, it is possible to suppress the occurrence of the separated flows between the conduit and the vaporizing heater as well. Therefore, it is possible to vaporize the liquid, which is not vaporized by the Stirling engine, with the vaporizing heater and obtain the target gas at high efficiency.

A vaporization apparatus according to the embodiment includes a Stirling engine including a heat exchange unit for cold energy, and a vaporizing tube which is attached to the Stirling engine while covering the heat exchange unit for cold energy and in which liquid circulates so as to come into contact with the heat exchange unit for cold energy. The vaporizing tube is attached to the Stirling engine at an angle set in advance. The angle set in advance is an angle at which an ascending flow of the liquid flowing from a bottom to a top of the heat exchange unit for cold energy can be formed and at which a flowing direction of the ascending flow is adjusted to suppress occurrence of separated flows of the liquid and gas in the vaporizing tube.

With this configuration, it is possible to suppress the occurrence of the separated flows in the vaporizing tube. Therefore, as explained above, even when the flow velocity of the liquid is low, it is possible to maintain the gas-liquid two-phase flow in which the gas and the liquid are mixed without a gas-liquid interface being separated. With the configuration, the liquid in the vaporizing tube comes into contact with the heat exchange unit for cold energy to vaporize. Therefore, it is possible to obtain the target gas at high efficiency.

Specifically, the vaporizing tube includes a heat exchange section that circulates the liquid such that the liquid comes into contact with the heat exchange unit for cold energy, a lead-in section for leading the liquid into the heat exchange section, and a lead-out section for leading out gas vaporized in the heat exchange section and the liquid from the heat exchange section. A channel in the vaporizing tube has a shape for circulating the liquid in a direction having an upward component in the entire range from the lead-in section to the lead-out section.

The vaporizing tube includes a heat exchange section that circulates the liquid such that the liquid comes into contact with the heat exchange unit for cold energy, and a lead-in section for leading the liquid into the heat exchange section. A sectional area of a channel in the led-in section is set smaller than a sectional area of a channel in the heat exchange section.

With this configuration, since the sectional area of the channel in the lead-in section is set smaller than the sectional area of the channel in the heat exchange section, it is possible to set the density of the liquid in the lead-in section higher than the density of the liquid in the heat exchange section. Therefore, it is possible to maintain a state in which a lot of cold energy is retained at a stage before the liquid is guided to the heat exchange section. As a result, it is possible to more effectively perform vaporization in the heat exchange section.

The heat exchange unit for cold energy includes an encapsulating section in which working gas of the Stirling engine is encapsulated, and a plurality of extending sections heat-conductibly coupled to the encapsulating section and extending upward from the encapsulating section. The vaporizing tube includes a heat exchange section which covers at least a part of the encapsulating section and in which the encapsulating section and the liquid come into contact with each other, and an auxiliary heat exchange section which covers the extending sections and in which the extending sections and the liquid come into contact with each other.

With this configuration, since the vaporizing tube includes not only the heat exchange section but also the auxiliary heat exchange section, it is possible to more effectively perform vaporization in a large area.

A vaporization system according to the embodiment includes the vaporization apparatus, a supply source capable of supplying liquid to the vaporizing tube of the vaporization apparatus, and a vaporizing heater for vaporizing the liquid led out from the vaporizing tube and heating gas led out from the vaporizing tube. The supply source supplies the liquid to the vaporizing tube at a flow velocity at which a gas-liquid two-phase flow in which the liquid and the gas are mixed is formed in the vaporizing tube.

With this configuration, it is possible to form the gas-liquid two-phase flow in which the liquid and the gas are mixed in the vaporizing tube. Therefore, the liquid contained in the gas-liquid two-phase flow is vaporized by the heat exchange unit for cold energy of the Stirling engine and the liquid not vaporized by the heat exchange unit for cold energy and led out as an ascending flow from the vaporizing tube is vaporized by the vaporizing heater. Therefore, it is possible to obtain target gas at high efficiency without requiring a complicated process and a complicated configuration.

The vaporizing tube includes a heat exchange section that circulates the liquid such that the liquid comes into contact with the heat exchange unit for cold energy. The supply source supplies the liquid to the vaporizing tube at a flow velocity at which an intermittent flow or an air bubble flow is formed in the heat exchange section.

With this configuration, it is possible to effectively bring the liquid contained in the gas-liquid two-phase flow and the heat exchange unit for cold energy of the Stirling engine into contact with each other by forming the intermittent flow or the air bubble flow in which the liquid circulates uniformly at a relatively low flow velocity. Therefore, it is possible to further improve efficiency of vaporization by the Stirling engine.

The vaporizing heater is provided above the vaporizing tube and receives the liquid and the gas led out from the vaporizing tube in the form of the ascending flow.

With this configuration, it is possible to surely guide the liquid and the gas to the vaporizing heater while suppressing occurrence of separated flows by forming the ascending flow between the vaporizing tube and the vaporizing heater as well. Therefore, it is possible to surely vaporize the liquid contained in the gas-liquid two-phase flow related to the ascending flow with the vaporizing heater. Therefore, with the configuration, it is possible to obtain target gas at higher efficiency.

INDUSTRIAL APPLICABILITY

As explained above, the vaporization method, the vaporization apparatus used for the vaporization method, and the vaporization system provided with the vaporization apparatus according to the present invention are useful for vaporizing the liquid while recovering power using the Stirling engine and is suitable for suppressing occurrence of separated flows of the liquid and the gas in the conduit of the vaporizing tube and maintaining the gas-liquid two-phase flow in which the gas and the liquid are mixed.

The invention claimed is:

1. A method of vaporizing liquid using a Stirling engine including a heat exchange unit for cold energy, the method comprising:

a preparing step of providing a conduit that covers at least a part of the heat exchange unit for cold energy of the Stirling engine and is capable of forming an ascending flow of the liquid flowing from a bottom to a top of the heat exchange unit for cold energy; and a vaporizing step of feeding the liquid in the conduit and thereby form the ascending flow and bringing the liquid into contact with the Stirling engine and vaporizing the liquid while cooling working gas of the Stirling engine at the heat exchange unit for cold energy, wherein in the vaporizing step, the liquid is fed at a flow velocity such that a mixture of the liquid and the gas is formed in the ascending flow and thereby suppress occurrence of separated flows of the liquid and gas in the conduit, leading the liquid out of the conduit after cooling the working gas of the Stirling engine from the conduit in a form of a gas-liquid two-phase flow, and wherein guiding the gas-liquid two phase flow from the conduit to a vaporizing heater and heating and vaporizing the gas-liquid two-phase flow with the vaporizing heater.

2. The vaporization method according to claim 1, wherein, the vaporizing step further comprises, feeding the liquid at a flow velocity to form an intermittent flow or an air bubble flow in a heat exchange section of the conduit in which the heat exchange unit for cold energy and the liquid come into contact with each other.

3. The vaporization method according to claim 1, wherein the conduit includes a heat exchange section in which the heat exchange unit for cold energy and the liquid come into contact with each other, and a lead-in section has a sectional area smaller than a sectional area of a channel of the heat exchange section which leads the liquid into the heat exchange section.

4. The vaporization method according to claim 1, wherein the heat exchange unit for cold energy includes an encapsulating section in which working gas of the Stirling engine is encapsulated, and a plurality of extending sections coupled to the encapsulating section and extending in a flowing direction of the liquid from the encapsulating section for heat exchange, the conduit includes a heat exchange section which covers at least a part of the encapsulating section and in which the encapsulating section and the liquid come into contact with each other, and an auxiliary heat exchange section which covers the extending sections and in which the extending sections and the liquid come into contact with each other, and in the vaporizing step, feeding the liquid at a flow velocity to form the gas-liquid two-phase flow in the heat exchange section and the auxiliary heat exchange section.

5. The vaporization method according to claim 1, wherein the step of guiding the liquid further comprises, the gas-liquid two-phase flow is flown in the form of the ascending flow from the conduit to the vaporizing heater for vaporizing the liquid and heating the gas.

6. A vaporization apparatus comprising:

a Stirling engine including a heat exchange unit for cold energy; and a vaporizing tube attached to the Stirling engine and covering the heat exchange unit for cold energy and in which liquid flows to cool working gas of the Stirling engine at the heat exchange unit for cold energy, wherein the vaporizing tube is attached to the Stirling engine, to form an ascending flow of the liquid flowing from a bottom to a top of the heat exchange unit for cold energy in the vaporizing tube and at which a flowing direction of the ascending flow is adjusted thereby suppressing occurrence of separated flows of the liquid and gas in the vaporizing tube, and a dimension of the vaporizing tube is set to lead the liquid out of the vaporizing tube after cooling the working gas of the Stirling engine in a form of a gas-liquid two-phase flow, wherein the vaporization apparatus further comprises a vaporizing heater used for heating and vaporizing the gas-liquid two-phase flow exiting from the vaporizing tube.

7. The vaporization apparatus according to claim 6, wherein the vaporizing tube includes a heat exchange section, wherein the liquid flows via the heat exchange section such that the liquid comes into contact with the heat exchange unit for cold energy, a lead-in section for leading out gas vaporized in the heat exchange section and the liquid from the heat exchange section, and a channel in the vaporizing tube has a shape for circulating the liquid in a direction having an upward component in an entire range from the lead-in section to the lead-out section.

8. The vaporization apparatus according to claim 6, wherein the vaporizing tube includes a heat exchange section, and wherein the liquid flows via the heat exchange section such that the liquid comes into contact with the heat exchange unit for cold energy, and a lead-in section for leading the liquid into the heat exchange section, and a sectional area of a channel in the led-in section is set smaller than a sectional area of a channel in the heat exchange section.

9. The vaporization apparatus according to claim 6, wherein the heat exchange unit for cold energy includes an encapsulating section in which working gas of the Stirling engine is encapsulated, and a plurality of extending sections coupled to the encapsulating section to exchange heat and extending upward from the encapsulating section, and the vaporizing tube includes a heat exchange section which covers at least a part of the encapsulating section and in which the encapsulating section and the liquid come into contact with each other, and an auxiliary heat exchange section which covers the extending sections and in which the extending sections and the liquid come into contact with each other.

10. A vaporization system comprising:

the vaporization apparatus according to claim 6;

a supply source capable of supplying liquid to the vaporizing tube of the vaporization apparatus;

wherein the supply source supplies the liquid to the vaporizing tube at a flow velocity at which a gas-liquid two-phase flow in which the liquid and the gas are mixed is formed in the vaporizing tube.

11. The vaporization system according to claim 10, wherein the vaporizing tube includes a heat exchange section that flows the liquid such that the liquid comes into contact with the heat exchange unit for cold energy, and the supply source supplies the liquid to the vaporizing tube at a flow velocity at which an intermittent flow or an air bubble flow is formed in the heat exchange section.

12. The vaporization system according to claim 11, wherein the vaporizing heater is provided above the vaporizing tube and receives the gas-liquid two-phase leading out from the vaporizing tube in the form of the ascending flow.

* * * * *